US007075247B2

(12) United States Patent
Lyle, Jr. et al.

(10) Patent No.: US 7,075,247 B2
(45) Date of Patent: Jul. 11, 2006

(54) CONTROLLER AND DRIVER ARCHITECTURE FOR DOUBLE-ENDED CIRCUITRY FOR POWERING COLD CATHODE FLUORESCENT LAMPS

(75) Inventors: Robert L. Lyle, Jr., Raleigh, NC (US); Steven P. Laur, Raleigh, NC (US)

(73) Assignee: Intersil Americas Inc., Milpitas, CA (US)

( * ) Notice: Subject to any disclaimer, the term of this patent is extended or adjusted under 35 U.S.C. 154(b) by 46 days.

(21) Appl. No.: 10/927,756

(22) Filed: Aug. 27, 2004

(65) Prior Publication Data

US 2005/0242738 A1 Nov. 3, 2005

Related U.S. Application Data

(60) Provisional application No. 60/566,037, filed on Apr. 28, 2004.

(51) Int. Cl.
*H05B 41/16* (2006.01)
*H05B 41/24* (2006.01)

(52) U.S. Cl. ..... 315/247; 315/209 T; 315/194

(58) Field of Classification Search ..... 315/247, 315/141–143, 172, 173, 175, 176, DIG. 5, 315/209 R, 212–214, 219, 220, 220 T, 254, 315/255, 257, 291, 307, 313, DIG. 4, 194
See application file for complete search history.

(56) References Cited

U.S. PATENT DOCUMENTS

| | | | | |
|---|---|---|---|---|
| 6,936,975 | B1 * | 8/2005 | Lin et al. | 315/224 |
| 6,954,364 | B1 * | 10/2005 | Min | 363/56.08 |
| 2003/0099122 | A1 * | 5/2003 | Cho | 363/125 |
| 2004/0232853 | A1 * | 11/2004 | Hur et al. | 315/291 |

* cited by examiner

*Primary Examiner*—Tuyet Vo
*Assistant Examiner*—Marei Antoinette Cabucos
(74) *Attorney, Agent, or Firm*—Allen, Dyer, Doppelt, Milbrath & Gilchrist, P.A.

(57) ABSTRACT

A distributed controller and DC voltage switch-driver system supplies AC power to a cold cathode fluorescent lamp of the type used to backlight a liquid crystal display. The system includes a local controller and lamp operation-monitoring subsystem, which generates two pairs of low voltage drive signals. These drive signals are distributed over low voltage wires to respective pairs of step-up transformer-driving switches installed at opposite ends of the lamp. The high voltage AC outputs of the two transformers have the same frequency, but opposite phase, to reduce the voltage ratings of the components that are installed at the opposite ends of the lamp. The use of low voltage connections from the local controller to driver circuitry at the far end of the lamp serves to reduce the cost of the components, and results in lower emitted noise and lower energy lost to capacitive coupling.

18 Claims, 1 Drawing Sheet

CONTROLLER AND DRIVER ARCHITECTURE FOR DOUBLE-ENDED CIRCUITRY FOR POWERING COLD CATHODE FLUORESCENT LAMPS

CROSS-REFERENCE TO RELATED APPLICATION

The present application claims the benefit of U.S. application Ser. No. 60/566,037, filed Apr. 28, 2004, entitled: "Controller and Driver Architecture for Double Ended Inverter for Powering CCFL Back Lights," assigned to the assignee of the present application and the disclosure of which is incorporated herein.

FIELD OF THE INVENTION

The present invention relates in general to power supply systems and subsystems thereof, and is particularly directed to a method and apparatus for supplying AC power to a high voltage device, such as a cold cathode fluorescent lamp of the type employed for backlighting a liquid crystal display.

BACKGROUND OF THE INVENTION

There are a variety of electrical system applications, which require one or more sources of high voltage AC power. As a non-limiting example, a liquid crystal display (LCD), such as that employed in desktop and laptop computers, or in larger display applications such as large scale television screens, requires an associated set of cold cathode fluorescent lamps (CCFLs) mounted directly behind it for backlighting purposes. In these and other applications, ignition and continuous operation of the CCFLs require a high AC voltage that can range on the order of several hundred to several thousand volts. Supplying such high voltages to these devices has been customarily accomplished using one of several methodologies.

A first approach involves the use a single-ended drive system, wherein a high voltage AC voltage generation and control system is transformer-coupled to one/near end of the lamp. This approach requires the generation of a very high peak AC voltage in the high voltage transformer circuitry feeding the driven end of the lamp.

Another approach is to generate double-ended drive with all switches and transformers placed close to one end of the lamp and high voltage coupled to both the near end and the far end with high voltage wire. These wires can be relatively long (e.g., 4 feet or more) and are more expensive than low voltage wires due to their high voltage insulation. In addition, they loose significant energy through capacitive coupling to ground.

Another approach is to place a high voltage transformer and associated voltage switching devices, such as MOSFETs or bipolar transistors, at both the near end and the far end of the lamp; these devices are connected to and controlled by a local controller at the near end of the lamp. This approach has disadvantages similar to the first, in that the gate (or base) drive wires are required to carry high peak currents and must change states at high switching speeds for efficient operation. The long wires required are not readily suited for these switching speeds, due to their inherent inductance; in addition they lose energy because of their substantial resistance.

An alternative and safer approach has been to drive the respective ends of the lamp with opposite phase AC voltages. For this purpose, a full control system including respective high voltage transformers, drivers and associated switching systems therefore may be installed at each end of the lamp, and being operative to drive near and far terminals of the lamp with equal and opposite AC voltages. This approach has the advantage that the drive voltages supplied to the opposite ends of the lamp may be reduced to half that of a single ended system. However, it adds complexity to the circuitry at the remote end of the lamp, and additionally requires interconnections between the two systems to synchronize the frequency and phase of each driver, as well as other functions such as brightness control.

SUMMARY OF THE INVENTION

In accordance with the present invention, such disadvantages associated with conventional high voltage AC power supply system architectures, such as those used for supplying AC power to a CCFL used to backlight an LCD, are effectively obviated by a distributed controller and DC voltage switch-driver architecture. This architecture includes a local controller and lamp operation-monitoring subsystem, that is operative to generate two pairs of relatively low voltage drive signals. A first pair of drive signals is distributed to drive circuits for first push-pull switching circuits installed at a near end of the lamp. A second pair of drive signals is distributed to drive circuits for second push-pull switching circuits installed at a far end of the lamp.

Opposite phase, high frequency ON/OFF keyed AC output signals produced by the switching circuits are stepped up to relatively high output voltages by step-up transformers, secondary (output) windings of which are respectively coupled to end terminals of the CCFL. This double-ended drive of the lamp is highly desirable, as it reduces the voltage ratings of the components that are installed at the opposite ends of the lamp. In addition to supplying drive signals for the near and far end switching circuits, the local controller subsystem is configured to monitor the voltage and current being supplied to CCFL by way of a local feedback and control loop.

In order to generate the pair of high frequency ON/OFF keyed AC signals to be distributed to the drivers for the near end and far end switching circuits, the local controller and driver subsystem contains a high frequency (e.g., 50 KHz) oscillator, the AC output of which is modulated by a pulse width modulator. The duty cycle of the PWM signal output by the pulse width modulator is controlled by the outputs of respective voltage and current sense circuits, that monitor the voltage and current being supplied to CCFL. LC tank circuits formed by the inductance of the transformers and capacitance of associated capacitors effectively convert high frequency square wave outputs of the switching circuits into sine waves having substantially suppressed harmonic components, so that opposite phase AC voltages applied to the opposite ends of the CCFL by output windings of the two step-up transformers are relatively true sine waves (ON/OFF-modulated in accordance with the duty cycle of a PWM signal produced at the controller's PWM drive outputs).

The voltage and current sense circuits that are used to control the duty cycle of the PWM signals are coupled to the secondary winding of the step-up transformer installed at the near end of the lamp. The outputs of these sense circuits are applied to respective voltage and current error amplifiers. The voltage error amplifier is further coupled to receive a prescribed overvoltage reference, that is representative of the peak voltage allowed across the CCFL. The current error amplifier is further coupled to receive a prescribed voltage representative of a peak reference current allowed to flow in the CCFL. The outputs of error amplifiers are coupled to an analog OR circuit, that produces as its output whichever one of its two inputs has the lower voltage.

When the system is initially turned on, there is no current flowing through the CCFL, while a very large AC (PWM-modulated 50 KHz) voltage is impressed across its two end terminals by the two sets of switching circuits. At this time, the output of the voltage error amplifier is the lower of the two inputs to the analog OR circuit, so that the duty cycle of the PWM generator is initially controlled by the voltage sense circuit. Once the lamp ignites, however, the voltage across its two end terminals drops and current begins to flow through the lamp. As the voltage across the lamp decreases and the current through it increases, the voltage output of the voltage sense circuit will eventually reach a value that is lower than the voltage output of the current sense circuit. Once this happens, the duty cycle of the PWM generator will be effectively controlled by the current sense circuit.

BRIEF DESCRIPTION OF THE DRAWINGS

The single FIGURE diagrammatically illustrates an embodiment of a DC-AC controller and driver architecture for a double-ended arrangement for powering a cold cathode fluorescent lamp in accordance with an embodiment of the present invention.

DETAILED DESCRIPTION

Figure 1:
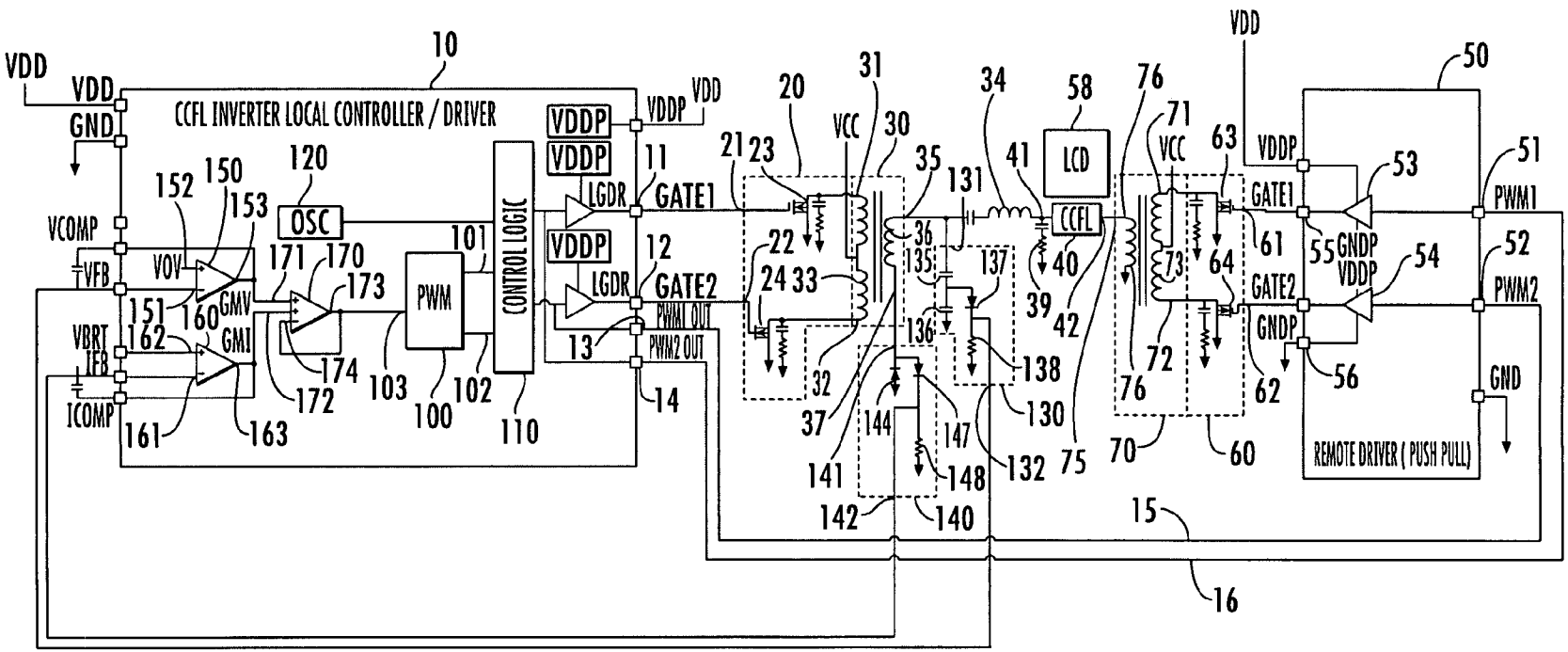

Before detailing the CCFL controller and driver architecture of the present invention, it should be observed that the invention resides primarily in a prescribed novel arrangement of conventional controlled power supply circuits and components. Consequently, the configuration of such circuits and components and the manner in which they may be interfaced with a driven device, such as a cold cathode fluorescent lamp have, for the most part, been shown in the drawings by a readily understandable block diagram, which shows only those specific aspects that are pertinent to the present invention, so as not to obscure the disclosure with details which will be readily apparent to those skilled in the art having the benefit of the description herein. Thus, the block diagram is primarily intended to show the major components of the invention in convenient functional groupings, whereby the present invention may be more readily understood.

Attention is now directed to the single FIGURE, which is a block diagram of the general architecture of a DC-AC controller and drive system for a double-ended drive system for powering a cold cathode fluorescent lamp, in accordance with a preferred embodiment of the present invention. As shown therein, the CCFL controller and drive system of the invention includes a relatively low voltage (e.g., on the order of several to several tens of volts) local controller/driver subsystem 10, which is operative to generate drive control outputs for a pair of lamp powering-circuits, one installed adjacent to each end of the lamp. These powering circuits include drivers and switching circuits, whose outputs are coupled to primary windings of an associated pair of step-up transformers, whose output windings are coupled to opposite terminals of a high voltage device, shown as a cold cathode fluorescent lamp (CCFL) 40. This double-ended drive of a high voltage device, such as a cold cathode fluorescent lamp, is highly desirable as it reduces (effectively halves) the voltage ratings of the components at the opposite ends of the lamp. In addition, the subsystem 10 is configured to monitor the voltage and current being supplied to the CCFL by way of a local feedback and control loop, as will be described.

The local controller and driver subsystem 10 has a first set of pulse width modulation (PWM)-based drive outputs 11 and 12, which are coupled to drive or control inputs 21 and 22 of respective switches 23 and 24 of a local push-pull switched lamp powering circuit 20. Although the switches 23 and 24 are shown as MOSFET devices, it is to be understood that other equivalent circuit components, such as bipolar transistors, IGFETs, or other voltage controlled switching devices, may be used. Moreover although push-pull switching circuitry is shown, other configurations, such as, but not limited to half-bridge and full-bridge topologies, may be employed.

The source-drain paths of the MOSFET switches of the lamp powering circuit are coupled to opposite terminals 31 and 32 of the primary winding 33 of a first (local) step-up transformer 30. Primary winding 33 has its center tap coupled to a prescribed DC voltage (e.g., VCC=24 VDC). Because the various internal circuits of the local controller and driver subsystem 10 are relatively low voltage devices, they may be readily interfaced with the primary windings of step-up transformer units at opposite ends of the CCFL by means of low voltage wires. This facilitates installation of the subsystem 10 immediately adjacent a first terminal end 41 of the CCFL. Placing the local controller and driver subsystem at this location minimizes the length of low voltage wiring through which the subsystem is connected to a remote drive unit 50, directly adjacent to a second end 42 of CCFL 40.

Step-up transformer unit 30 has an output 35 derived from a secondary winding 36 thereof, output 35 being coupled through an inductor 38 to the near end 41 of CCFL 40. In a practical application of the invention, described briefly above, CCFL 40 may be of the type that is used for backlighting a liquid crystal display unit 58 disposed adjacent thereto. The inductance of step-up transformer unit 30 and the inductance of inductor 34, together with that of capacitors of a voltage sense circuit 130, to be described, and an output capacitor 39 from an LC tank circuit that is tuned to the (50 KHz) frequency of a clock generator or oscillator 120 within the local driver 10. As will be described, the output of oscillator 120 is controllably applied to the gate drive inputs 21 and 22 of the respective MOSFET switches 23 and 24 of switched lamp powering circuit 20. The tank circuit effectively converts the square wave outputs of the MOSFETs 23 and 24 into a sine wave having substantially suppressed harmonic components, so that what is applied to the opposite end terminals 41 and 42 of CCFL 40 is a relatively true sine wave, that is ON/OFF-modulated in accordance with the duty cycle of a PWM signal produced at the controller's PWM drive outputs 11 and 12.

The local controller and driver subsystem 10 further includes a second set of PWM drive outputs 13 and 14, identical to the first set, and coupled by way of low voltage (and therefore low cost) connection wires 15 and 16 to respective inputs 51 and 52 of remote driver unit 50, located adjacent to the far end terminal 42 of the CCFL 40. As described briefly above, in contrast to prior art architectures, which provide connections from the controller to the CCFL over high voltage wires, the present invention's use of low voltage connections (15 and 16) from the local controller 10 to the remote driver circuitry 50 adjacent to the far end of CCFL 40 serves to reduce the cost of the components (here the wires); in addition, it results in lower emitted noise and lower energy lost to capacitive coupling.

The remote drive unit 50 contains respective drivers 53 and 54, coupled to its inputs 51 and 52, and having outputs 55 and 56 thereof coupled to the drive (gate) inputs 61 and 62 of respective (MOSFET) switches 63 and 64 of a remote switched powering unit 60. MOSFET switches 63 and 64 have their source-drain paths coupled to opposite terminals 71 and 72 of the primary winding 73 of a second step-up transformer 70 located adjacent to the far end of the CCFL. Primary winding 73 has its center tap coupled to a prescribed DC voltage (e.g., VCC=24 VDC). Step-up transformer 70 has an output 75, derived from a secondary winding 76 thereof, coupled to the far end 42 of CCFL 40. In effect, except for the inversion of control inputs to its switches 63 and 64 as provided by driver unit 50, remote switched powering unit 60 is identical to the local lamp powering unit 20 coupled to the near end of the CCFL. This allows voltage and current error measurement circuitry within the local controller and driver subsystem 10 to be used for controlling driver circuits at both ends of the CCFL.

The internal circuitry of the local controller and driver subsystem 10 includes a PWM signal generator 100, respective outputs 101 and 102 of which are coupled to control logic 110. Control logic 110 is operative to generate switch drive signals for driving the gate inputs of MOSFET switches 23 and 24 within unit 20, and the MOSFET switches 63 and 64 within unit 60. Also coupled to the control logic 110 is the output of oscillator 120 which, as described above, produces a high frequency square wave having a frequency on the order of 50 KHz. The control logic 110 is operative to modulate this 50 KHz signal with the output of the PWM signal generator 100, such that the outputs of the control logic effectively correspond to an ON/OFF-keyed 50 KHz signal, whose ON time corresponds to a first (e.g., high) portion of the PWM signal and whose OFF time corresponds to a second (e.g., low) portion of the PWM signal.

The duty cycle of the PWM signal produced by PWM signal generator 100 is controlled in accordance with the outputs of voltage and current sense circuits 130 and 140, respective inputs 131 and 141 of which are coupled to opposite ends of the secondary winding 36 of step-up transformer 30, and outputs 132 and 142 of which are coupled to inverting (−) inputs 151 and 161 of respective voltage and current error amplifiers 150 and 160, which are implemented as error amplifiers. A second, non-inverting (+) input 152 of the voltage error amplifier 150 is coupled to receive a prescribed overvoltage reference (VOV), representative of the peak voltage allowed across the CCFL. The second, non-inverting (+) input 162 of the current error amplifier 160 is coupled to receive a prescribed (brightness representative) voltage VBRT, representative of a peak reference current allowed to flow in the CCFL 40. Error amplifiers 150 and 160 have the respective outputs 153 and 163 thereof coupled to non-inverting (+) inputs 171 and 172 of an analog OR circuit 170, the output 173 of which is coupled to its inverting (−) input 174 and to the input 103 of PWM generator 100.

Analog OR circuit 170 is operative to produce an output of whichever one of its two (+) inputs has the lower voltage. As will be described, at start-up, with no current flowing through the CCFL 40, the output 163 of current error amplifier 160 is the lower of the two inputs to the analog OR circuit 170, so that the duty cycle of the PWM generator 100 is effectively controlled by the current sense circuit 140. Once the CCFL 40 ignites, however, the voltage across its end terminals 41 and 42 drops, and current begins to flow through the lamp, causing the duty cycle of the PWM generator 100 to eventually be controlled in accordance with the output of the voltage sense circuit 130.

As described above, the output 132 of the voltage sense circuit 130 is coupled to the inverting (−) input 151 of error amplifier 150, while the output 142 of current sense circuit 140 is coupled to the inverting (−) input 161 of error amplifier 160. Voltage sense circuit 130 comprises a voltage divider formed by a pair of capacitors 135 and 136 coupled in series between ground and output 35 of secondary winding 36 of step-up transformer 30. The common connection of capacitors 135 and 136 is coupled through a rectifying diode 137 and a resistor 138 to ground, with the common connection of diode 137 and resistor 138 serving as the output 132 of voltage sense circuit 130. The values of the capacitors 135 and 136 are ratioed such that the voltage across capacitor 136 is scaled substantially relative to the relatively large (e.g., several thousand volts) voltage appearing across the secondary winding 36 of transformer 30. In effect, diode 137 supplies a half-wave rectified voltage on the order of only a few volts RMS relative to the voltage being applied to the transformer. This half-wave rectified voltage is fed back to the voltage error amplifier 150 to be compared to a prescribed overvoltage (VOV) value. Voltage error amplifier 150 is used to control how high the voltages applied to the opposite ends of the CCFL can go, with the peak being limited to the overvoltage reference value VOV.

The current sense circuit 140 comprises a diode 144 having its anode coupled to ground and its cathode coupled to a second end 37 of the secondary winding 36 of transformer 30. The second end 37 of the secondary winding 36 of transformer 30 is further coupled through a diode 147 and a resistor 148 to ground, with the common connection of diode 147 and resistor 148 serving as output 142 of current sense circuit 140. As such, current sense circuit 140 operates as a half-wave rectifier, with the rectified current that passes through resistor 148 producing a half-wave rectified voltage thereacross, which is representative of the RMS value of the current through the transformer's secondary winding. This voltage is compared in the current error amplifier 160 with a reference voltage VBRT representative of the peak current that is allowed to flow in the CCFL. Error amplifiers 150 and 160 have the respective outputs 153 and 163 thereof coupled to non-inverting (+) inputs 171 and 172 of analog OR circuit 170, the output 173 of which is coupled to its inverting (−) input 174 and to the input of PWM generator 100. As pointed out above, analog OR circuit 170 produces as its output whichever one of its two non-inverting (+) inputs has the lower voltage.

Operation of the CCFL controller and driver architecture described above is as follows. Before it is turned on, CCFL 40 is dark, and appears as an open circuit between its two end terminals 41 and 42. When the CCFL controller is turned on, PWM generator 100 produces a pulse width modulation signal at a prescribed duty cycle associated with the intended brightness of the illumination output produced by the CCFL, as defined by the voltage VBRT applied to the non-inverting input 162 of error amplifier 160. The control logic 110 modulates the PWM signal produced by PWM generator 100 onto the 50 KHz signal produced by oscillator 120, to realize complementary ON/OFF keyed 50 KHz waveforms at outputs 11, 12, and at outputs 13, 14 of the local controller and driver subsystem 10. The outputs 11 and 12 control the gates of MOSFETs 23 and 24 in a complementary, push-pull manner, so that MOSFET 23 is turned on, while MOSFET 24 is turned off, and vice versa.

Similarly, the outputs 13 and 14 of the local control and driver subsystem 10 are controlled in a like push-pull manner, such that MOSFET 63 is turned off, while MOSFET 23 is turned on, and MOSFET 64 is turned on, while MOSFET 24 is turned off, and vice versa. This complementary operation of the two MOSFET switch pairs in the driver circuitry at opposite ends of the CCFL 40 produces respective complementary sinusoidal waveforms in the primary winding 33 of the step-up transformer 30 connected to the first end terminal 41 of CCFL 40 and in the primary winding 73 of step-up transformer 70 connected to the first end terminal 42 of CCFL 40. These two voltage waveforms are stepped-up by the two transformers' secondary windings 36 and 76, so as to produce complimentarily modulated 50 KHz high voltage sinusoidal waveforms across the CCFL.

At start-up, prior to the flow of lamp current through the CCFL 40, a very large voltage (on the order of several hundred to several KV depending upon the size of the CCFL) is applied across the CCFLs end terminals. With no current flowing, (but with a very large voltage (e.g., on the order of several KV) applied across the CCFL) the output of the current sense circuit 140 will cause the output of current error amplifier 160 to be higher than the output of voltage error amplifier 150, so that the output of OR circuit 170 will correspond to the output of voltage error amplifier 150, and the PWM generator 100 will be controlled by the voltage sense circuit 130.

With a very large voltage applied across its end terminals, CCFL 40 will ignite, and current will begin to flow through it and the secondary windings of the two transformers 30 and 70. As current flows through the secondary winding 36 of the near end transformer 30, it is detected by the current sense circuit 140 and a voltage representative thereof is applied to current error amplifier 160. At the same time, with current flowing through it, the voltage across the end terminals of the CCFL begins to drop. As the voltage across the CCFL drops and the current through it increases, the voltage output of the voltage sense circuit 130 becomes lower than the positive input (152) to the voltage error amplifier 150 (VOV) and voltage output of the current sense circuit 140 will increase to a value greater than or equal to the positive input 162 to the current error amplifier 160. The output of the voltage error amplifier 150 will increase and the output of the current amplifier will decrease and become less than the output of the voltage error amplifier. Once this happens, the output of the analog OR 170 will become equal to the output of the current amplifier 160 and the duty cycle of the PWM generator 100 will be effectively controlled by the current sense circuit 140.

As will be appreciated from the foregoing description, drawbacks of conventional DC-AC power supply system architectures, such as those supplying high voltage AC power to a cold cathode fluorescent lamp of the type used to backlight an LCD, are effectively obviated by the distributed controller and driver architecture of the invention, which includes a local controller and lamp operation-monitoring subsystem, that is operative to generate two pairs of relatively low voltage drive signals. As these signals are low voltage signals, they may be readily be distributed from the local controller over relatively low voltage wires to respective pairs of transformer-driving switching circuits installed at opposite ends of the lamp. This use of low voltage connections from the local controller to respective driver circuitry at the near end and far end of the lamp serves to reduce the cost of the components. It also results in lower emitted noise and lower energy lost to capacitive coupling. Moreover, as described above, double-ended drive of the lamp is highly desirable, as it reduces the voltage ratings of the components installed at the opposite ends of the lamp.

While we have shown and described a preferred embodiment in accordance with the present invention, it is to be understood that the same is not limited thereto but is susceptible to numerous changes and modifications as known to a person skilled in the art, and we therefore do not wish to be limited to the details shown and described herein, but intend to cover all such changes and modifications as are obvious to one of ordinary skill in the art

What is claimed is:

1. An apparatus for supplying AC power to a high voltage device comprising:

a first, low voltage, local controller and switching circuit-driver subsystem, which is operative to generate first, low voltage, drive control signals for controlling the operation of a first driver circuit therein that generates first drive signals for a first switching circuit installed adjacent to a first end of said high voltage device, and the operation of a second driver circuit that generates second drive signals for a second switching circuit of a second switching circuit-driver subsystem installed adjacent to a second end of said high voltage device;

a first low voltage connection path which is operative to couple said first, low voltage drive control signals generated by said first, low voltage, local controller and switching circuit-driver subsystem to said first driver circuit therein that generates said first drive signals for said first switching circuit, and to couple said first drive signals to said first switching circuit;

a second low voltage connection path which is operative to transport said first, low voltage drive control signals from said first, low voltage local controller and switching circuit-driver subsystem to said second driver circuit of said second switching circuit-driver subsystem;

a first step-up transformer having a primary winding coupled to an output of said first switching circuit, and a secondary winding coupled to a first terminal of said high voltage device, and being operative to couple a first AC voltage to said first terminal of said high voltage device; and a second step-up transformer having a primary winding coupled to an output of said second switching circuit, and a secondary winding coupled to a second terminal of said high voltage device, and being operative to couple a second AC voltage having the same frequency as, but opposite phase relative to said first AC voltage to said second terminal of said high voltage device.

2. The apparatus according to claim 1, wherein said high voltage device comprises a cold cathode fluorescent lamp of the type used to backlight a liquid crystal display.

3. The apparatus according to claim 1, wherein said first, local controller and switching circuit-driver subsystem is operative to generate said first, low voltage, drive control signals in accordance with voltage and current supplied to said high voltage AC device.

4. The apparatus according to claim 1, wherein said first, local controller and switching circuit-driver subsystem is operative to generate said first, low voltage, drive control signals as pulse width modulated high frequency AC signals.

5. The apparatus according to claim 4, wherein said pulse width modulated high frequency AC signals have a duty cycle thereof defined in accordance with voltage and current supplied to said high voltage AC device.

6. The apparatus according to claim 5, wherein said high voltage device comprises a cold cathode fluorescent lamp of the type used to backlight a liquid crystal display.

7. The apparatus according to claim 6, wherein said first, local controller and switching circuit-driver subsystem is operative to generate said first, low voltage, drive control signals in accordance with voltage and current supplied to said high voltage AC device.

8. A method of supplying AC power to a high voltage device comprising the steps of:

(a) at a first circuit location relative to said high voltage device, generating first low voltage drive control signals for controlling the operation of a first driver circuit for a first switching circuit within a first switching circuit-driver subsystem installed adjacent to a first end of said high voltage device, and generating second low voltage drive control signals for controlling the operation of a second driver circuit for a second switching circuit within a second switching circuit-driver subsystem installed adjacent to a second end of said high voltage device;

(b) coupling said first low voltage drive control signals generated in step (a) over a first low voltage connection path to said first driver circuit of a said first switching circuit-driver subsystem, and coupling said second low voltage drive control signals generated in step (a) over a second low voltage connection path to said second driver circuit of said second switching circuit-driver subsystem;

(c) driving a primary winding of a first step-up transformer with first AC output signals produced by said first switching circuit, so that a secondary winding of said first step-up transformer couples first high voltage AC signals to a first terminal at said first end of said high voltage device; and (d) driving a primary winding of a second step-up transformer with second AC output signals produced by said second switching circuit, so that a secondary winding of said second step-up transformer couples second high voltage AC signals to a second terminal at said second end of said high voltage device, said second high voltage AC signals having the same frequency as, but opposite phase relative to said first high voltage AC signals.

9. The method according to claim 8, wherein said high voltage device comprises a cold cathode fluorescent lamp of the type used to backlight a liquid crystal display.

10. The method according to claim 8, wherein step (a) comprises generating said first and second low voltage drive control signals in accordance with voltage and current supplied to said high voltage AC device.

11. The method according to claim 8, wherein said first and second low voltage drive control signals comprise pulse width modulated high frequency AC signals.

12. The method according to claim 11, wherein said pulse width modulated high frequency AC signal have a duty cycle thereof defined in accordance with voltage and current supplied to said high voltage AC device.

13. The method according to claim 12, wherein said high voltage device comprises a cold cathode fluorescent lamp of the type used to backlight a liquid crystal display.

14. The method according to claim 13, wherein step (a) comprises generating said first and second low voltage drive control signals in accordance with voltage and current supplied to said high voltage AC device.

15. For use with a comprises a cold cathode fluorescent lamp (CCFL) of the type used to backlight a liquid crystal display, an apparatus for supplying AC power to said CCFL comprising:

a local controller and lamp operation-monitoring subsystem, located adjacent to a first end of said CCFL, and being operative to generate first and second pairs of relatively low voltage drive signals, wherein said first pair of relatively low voltage drive signals is distributed over first low voltage wires to drive circuits for first switching circuits of a first switching circuit-driver subsystem, installed at said first end of said CCFL, and said second pair of relatively low voltage drive signals is distributed over second low voltage wires to drive circuits for second switching circuits of a second switching circuit-driver subsystem, installed at a second end of said CCFL;

a first step-up transformer having a primary winding coupled to outputs of said first switching circuits of said first switching circuit-driver subsystem, and a secondary winding coupled to a first terminal of said CCFL, and being operative to couple a first high AC voltage to said first terminal of said CCFL; and a second step-up transformer having a primary winding coupled to outputs of said second switching circuits of said second switching circuit-driver subsystem, and a secondary winding coupled to a second terminal of said CCFL, and being operative to couple a second high AC voltage having the same frequency as, but opposite phase relative to said first high AC voltage to said second terminal of said CCFL.

16. The apparatus according to claim 15, wherein said local controller and lamp operation-monitoring subsystem is operative to generate said first and second pairs of relatively low voltage drive control signals in accordance with voltage and current supplied to said CCFL.

17. The apparatus according to claim 16, wherein said local controller and lamp operation-monitoring subsystem is operative to generate said first and second pairs of relatively low voltage drive control signals as pulse width modulated high frequency AC signals.

18. The apparatus according to claim 17, wherein said pulse width modulated high frequency AC signals have a duty cycle thereof defined in accordance with voltage and current supplied to said CCFL.

* * * * *